US006732797B1

(12) United States Patent
Watters et al.

(10) Patent No.: US 6,732,797 B1
(45) Date of Patent: May 11, 2004

(54) METHOD OF FORMING A CEMENTITIOUS PLUG IN A WELL

(76) Inventors: Larry T. Watters, 1618 Jones, Suite 400, Duncan, OK (US) 73533; Freddie L. Sabins, 4613 Brookwoods, Houston, TX (US) 77092-8339

( * ) Notice: Subject to any disclaimer, the term of this patent is extended or adjusted under 35 U.S.C. 154(b) by 36 days.

(21) Appl. No.: 10/188,180

(22) Filed: Jul. 2, 2002

Related U.S. Application Data

(60) Provisional application No. 60/311,965, filed on Aug. 13, 2001.

(51) Int. Cl.[7] ..... E21B 33/13; E21B 33/05

(52) U.S. Cl. ..... 166/291; 166/285

(58) Field of Search ..... 166/291, 313, 166/285

(56) References Cited

U.S. PATENT DOCUMENTS 3,572,438 A * 3/1971 Rohe ..... 166/285
3,613,790 A * 10/1971 Stout et al. ..... 166/295
3,995,694 A * 12/1976 Freiburger ..... 166/285
4,043,394 A * 8/1977 Campbell ..... 166/290
4,429,746 A * 2/1984 Allard ..... 166/291
4,869,321 A * 9/1989 Hamilton ..... 166/291
5,469,918 A * 11/1995 Haberman ..... 166/291
6,595,289 B2 * 7/2003 Tumlin et al. ..... 166/286

* cited by examiner

*Primary Examiner*—David Bagnell
*Assistant Examiner*—S. Thomas Bomar
(74) *Attorney, Agent, or Firm*—Thomas R. Weaver

(57) ABSTRACT

A method of forming a cementitious plug in a well is disclosed. According to the method, a well is selected for treatment which lacks sufficient formation pressure to cause well fluid to naturally flow to the surface of the well. In addition, a formation penetrated by the well has unobstructed access between it and the surface. Having thus selected a well for treatment, a liquid slurry comprising a cementitious material, whose density is greater than the density of the well fluid, is introduced into the well. The slurry is permitted to drive the well fluid into the formation. Sufficient slurry is added to the well to fill the well to the surface. The slurry is then permitted to set into a hardened mass.

12 Claims, 1 Drawing Sheet

METHOD OF FORMING A CEMENTITIOUS PLUG IN A WELL

This application claims the benefit of Provisional Application 60/311,965 filed Aug. 13, 2001.

BACKGROUND OF THE INVENTION

1. Technical Field of the Invention

This invention broadly relates to well cementing. The invention further relates to well plugging. The invention more particularly relates to a method of forming a cement plug in a well bore.

2. Description of the Prior Art and Problems Solved

The term, "primary cementing," is employed by persons skilled in the art of well cementing to refer to the formation of a sheath of cement in the annular space between the wall of a bore hole drilled in the earth and the exterior wall of a casing positioned in the bore hole. The sheath is ordinarily formed as a part of the initial construction of a well, such as a well which produces hydrocarbons, for example, liquid petroleum and natural gas, from a subterranean earth formation. The purpose of the sheath is to stabilize the bore hole, support the casing in the bore hole and segregate subterranean formations which contain hydrocarbons from subterranean formations which contain water, particularly potable water. The sheath of cement can extend from the bottom of the casing to the surface of the earth. A method of forming the sheath is well known.

The term "casing" is employed in the previous paragraph to broadly refer to at least one and usually two or more tubular conduits of decreasing diameter which, together in a telescoping mode, extend from the surface of the earth to the bottom of the bore hole. In one typical example, a so-called surface casing having a large diameter continuously extends from the surface of the earth to a point below the deepest formation which contains potable water. A second casing, sometimes called a production casing whose outside diameter is less than the inside diameter of the surface casing, continuously extends from the surface of the,earth to a target formation, such as one which contains hydrocarbons. A sheath of cement is placed in the entire annular space between the surface casing and the bore hole and a second sheath of cement is placed in the annular space from the bottom of the production casing to a point above the target formation.

When the producing life of a well is complete, such as when recovery of hydrocarbons from the well is no longer economically sound, the well is abandoned. Abandoned wells pose a variety of hazards, one of which is the potential of undesirable fluids, such as hydrocarbons and/or salt water, which originate from subterranean formations penetrated by the bore hole, to migrate to and contaminate potable water in other subterranean formations which are also penetrated by the bore hole. To prevent such contamination, regulatory agencies in the several states require that abandoned wells be plugged, such as by placing a mass of hardened cementitious material in the well bore at least at points adjacent hydrocarbon producing formations and also at points adjacent potable water formations. Such plugs completely occupy the well bore volume adjacent the formations and function as a barrier to migrating fluids.

The current method of plugging a well broadly comprises forming a slurry of cement in water at the well head, introducing a continuous connected string of delivery pipe (sometimes called tubing), into the well bore until the bottom of the tubing attains a desired point of delivery of the slurry, pumping the slurry down the tubing to the bottom thereof and back up the exterior thereof, continuing pumping until a desired quantity of slurry has been deposited in the well bore to form a plug therein, and then withdrawing the tubing from the well bore. In the current method when the tubing is withdrawn from the well bore, the top of the slurry on the exterior of the tubing is preferably at the same level as the slurry in the interior of the tubing. This is referred to as a balanced plug. Before a second balanced plug can be placed, the cement in the preceding plug must first be permitted to set to a minimum hardened condition. Accordingly, if multiple plugs are required, then they cannot all be placed in a continuous operation due to the need to wait on cement to set.

Note use of the terms "bore hole" and "well bore." For purposes of disclosure, the term "bore hole" is employed to describe the linear hole actually drilled in the earth. The wall of the bore hole is the earthen rock exposed by the drill. The term "well bore" is employed to describe the containment vessel for the conduit or the intended conduit through which fluids pass between the surface of the earth and subsurface formations penetrated by the bore hole. It is common to install a continuous string of casing in the interior of the bore hole. The volume of the interior of the casing is the well bore. The volume between the wall of the bore hole and the exterior surface of the casing is referred to as the annular space. Thus, primary cementing involves placing cement in the annular space and well plugging involves placing cement in the well bore. In the absence of a casing it is clear that there is no annular space and there is no distinction between bore hole and well bore.

Persons skilled in the art know that considerable surface equipment is required to perform the current method of well plugging. Such equipment comprises a derrick to suspend tubing in the hole, transports for delivering to and storing dry cement and water at the well head, equipment at the well head for blending and mixing the cement and water to form the slurry and a high volume/high pressure pump at the well head to pressure the slurry down the suspended tubing and back up the exterior thereof to a predetermined destination.

The current method is employed to produce cement plugs in wells regardless of depth, and is particularly useful to form plugs in wells whose internal pressures are sufficiently high to cause fluids to naturally flow to the surface of the earth. Such wells require the use of methods and equipment which function to control such pressures and to prevent the flow of fluids from the well while the cementing operation is proceeding.

A need thus exists for a method of forming cement plugs in wells whose internal pressures are not sufficiently high to cause formation fluids to flow to the surface of the earth.

THE INVENTION

Summary of the Invention

By this invention there is provided a method of well cementing which comprises forming a plug of cement in the well bore. According to the method of the invention, a suitable bore hole is first selected. Upon selection of a suitable bore hole, a liquid comprising a cementitious slurry is introduced into the well bore at the surface of the earth. The liquid is permitted to descend in the well bore by gravity, form a column of slurry to a desired point in the well bore and then permitted to harden therein to form a plug. The bulk density of the introduced liquid is selected so that it, when multiplied by the distance from the surface of the earth to a designated location in the well bore, produces a pressure which is in excess of the natural pressure at the face of any subsurface formation actually contacted by the liquid. The method of this invention thus depends upon hydrostatic pressure generated by introduced liquid and not on mechanical pressure generated by a surface pump.

A suitable bore hole is one which penetrates at least one subsurface formation which produces a well fluid other than fresh water, wherein the natural pressure of the formation is not great enough to cause the well fluid to flow from the formation through the bore hole to the surface of the earth. The formation must possess sufficient permeability and porosity to permit the well fluid to be injected into it within an acceptable period of time by pressure induced at the formation face by hydrostatic pressure in the well bore and the formation must also possess sufficient structural strength to avoid being fractured by such induced pressure.

The method of this invention features positioning all plugs required within the entire well bore in one continuous operation without stopping to wait for a preceding plug to set. Thus, the reference in the preceding paragraph to an "acceptable period of time" of injection of well fluid into a subsurface formation is the amount of time that a slurry must remain in a flowable liquid state before it begins to set. It is believed that such an "acceptable period of time" is in the range of from about 8 to about 10 hours. A set time in the range of 8 to 10 hours can be selected by the addition to the slurry of known set time additives.

As mentioned, the formation into which well fluid is injected must also possess sufficient structural strength to avoid being fractured by the total hydrostatic pressure produced at the formation. In this regard, if the total hydrostatic pressure at a formation divided by the distance to the formation from the surface, i.e. the pressure gradient, is a value in the range of from about 0.4 to about 0.5 lb/sq.in. per foot of depth, then it is believed that a fracture will not be produced in the formation. For example, a liquid having a bulk density equal to the density of water (62.43 lb/cu.ft.) in a well having a depth of about 6500 feet produces a pressure gradient of about 0.4335 lb/sq.in. per foot of depth.

In addition to the low probability that a fracture will be induced by the hydrostatic pressure created by liquid in a well that is less than or equal to about 6500 feet deep, the well bore temperature in such wells is considered by persons skilled in the art to be low. Minimal performance requirements are demanded of cement at low temperature applications, so a wide range of cement compositions will operate.

Accordingly, by the method of this invention, a suitable well is first selected. Such a well is one which is no longer productive of useful well fluids, such as oil and gas, and has a subsurface formation containing such well fluids which is penetrated by a bore hole. The term well fluid can also include water produced from the formation which is sometimes referred to as produced formation water. The formation is not blocked by any device in the bore hole and, thus, has unobstructed access to the surface of the earth via the well bore. The natural pressure in the formation is not great enough to cause well fluids to flow to the surface of the earth. Such a condition can be evidenced by a static column of well fluid in the well bore which does not reach the surface of the earth.

Having thus located such a candidate well, the next step in the selection method is to determine whether the formation has sufficient porosity and permeability to accept low viscosity fluids in an acceptable period of time without undergoing a fracture. Accordingly, a simple injectivity test is performed by filling the well bore to the surface of the earth with a measured quantity of a fluid having a known density and a known viscosity; permitting fluid to flow into the mentioned formation; measuring the time required for fluid in the well bore to attain a static condition; and measuring the level of the attained static column of fluid. The measured quantity of fluid introduced into the well bore is that quantity which is equal to the volume of the well bore between the formation and the surface of the earth less the quantity of the static column of well fluid initially present therein. The quantity of fluid which actually enters the formation is determined by appropriate mathematical combination of fluid in the well bore before the test, the quantity of fluid in the well bore after the test and the measured quantity of fluid introduced into the well bore during the test. The density of the fluid added during the test is at least equal to, and is preferably greater than, the density of the fluid initially at rest in the well bore. The natural pressure within the formation can be calculated by those skilled the art by use of the density of the well fluid and the height of the static column of fluid above the formation. The porosity and permeability of the formation is then determined by application of, for example, the D'arcy Equation which is known by those skilled in the art of reservoir evaluation.

Having thus selected a candidate well, the method of this invention is further comprised of forcing at least a portion of the well fluid initially standing in the well bore from the well bore into the subsurface formation or formations of its source while, simultaneously, entirely replacing such portion, in one aspect, with a single quantity of a first liquid comprising a cementitious material, or, in a second aspect, with a combination of the first liquid, a second liquid and dense spacing discs or plugs followed by a single quantity of the first liquid.

The combination of first liquid, second liquid and dense spacing discs or plugs is defined herein as "a cementing unit" which consists of two spacings discs, a single quantity of first liquid and a single quantity of second liquid, wherein the spacing discs are placed between successive quantities of second liquid and, first liquid or between well fluid and first liquid as the case may be.

The single quantity of first liquid is defined herein as "a final unit" which consists of a single quantity of cementitious material and one spacing disc.

In the mentioned second aspect, the method of this invention is comprised of a series of steps which operate to force the well fluid into the subsurface formation or formations of its source in stages by employing at least one cementing unit and a final unit, wherein at least one cementing unit is employed per subsurface formation containing an undesirable well fluid. The final unit is used to block formations containing potable water. The entire well bore from the bottom thereof to the surface is filled with the cementing units and the final unit.

Guided by the known relationship that pressure is the product of height and density, to create hydrostatic pressure sufficient to force the well fluid into the formation the bulk density of the cementing units and final unit can be equal to or greater than the bulk density of the well fluid. Furthermore, the hydrostatic pressure created by the weight of the combination of cementing units and final unit at the formation must be greater than the natural reservoir (pore) pressure of the formation. Methods of preparing the first liquid, which is comprised of cementitious material, and the second liquid, which is a spacer fluid, each having a desired density, are well known in the art of well cementing.

Descriptions of the cementitious materials, spacer fluids and spacing discs as well as a more detailed account of the steps employed in the method of this invention are provided below in connection with the drawings and appended example.

DESCRIPTION OF THE PREFERRED EMBODIMENTS

Figure 1:
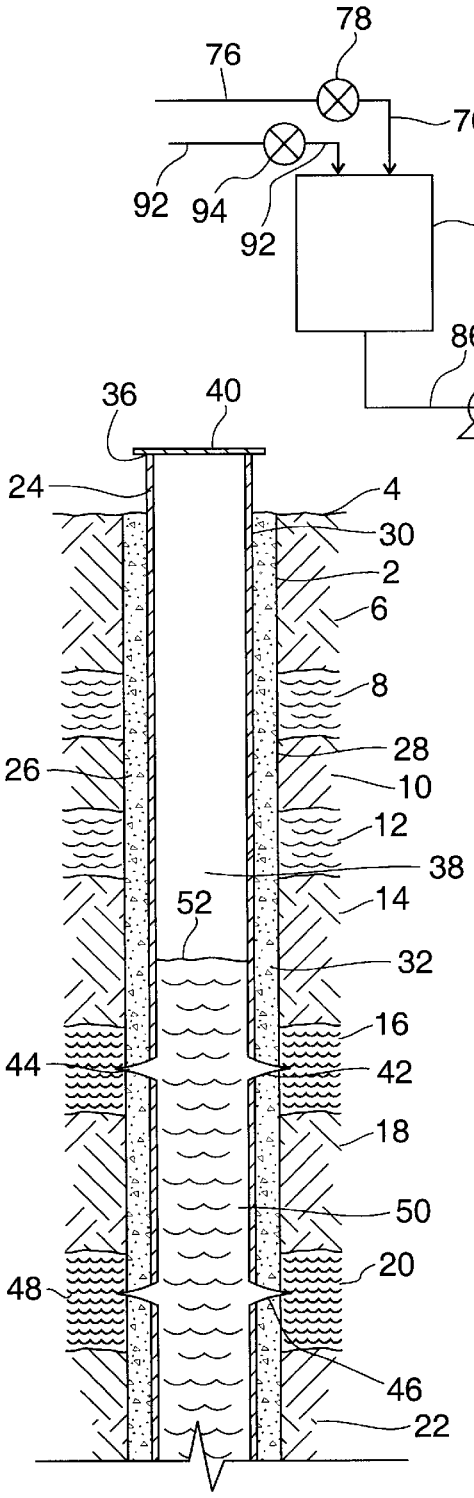
FIG. 1 is a drawing of an abandoned well which penetrates various subsurface formations, including those having fluids originating therefrom.

Referring now to the drawings, bore hole 2 is shown penetrating the surface 4 of the earth and extending therein and completely passing through subsurface formations 6, 8, 10, 12, 14, 16, 18, and 20 and entering, but not completely passing through, subsurface formation 22. Bore hole 2 thus terminates in formation 22.

Figure 2:
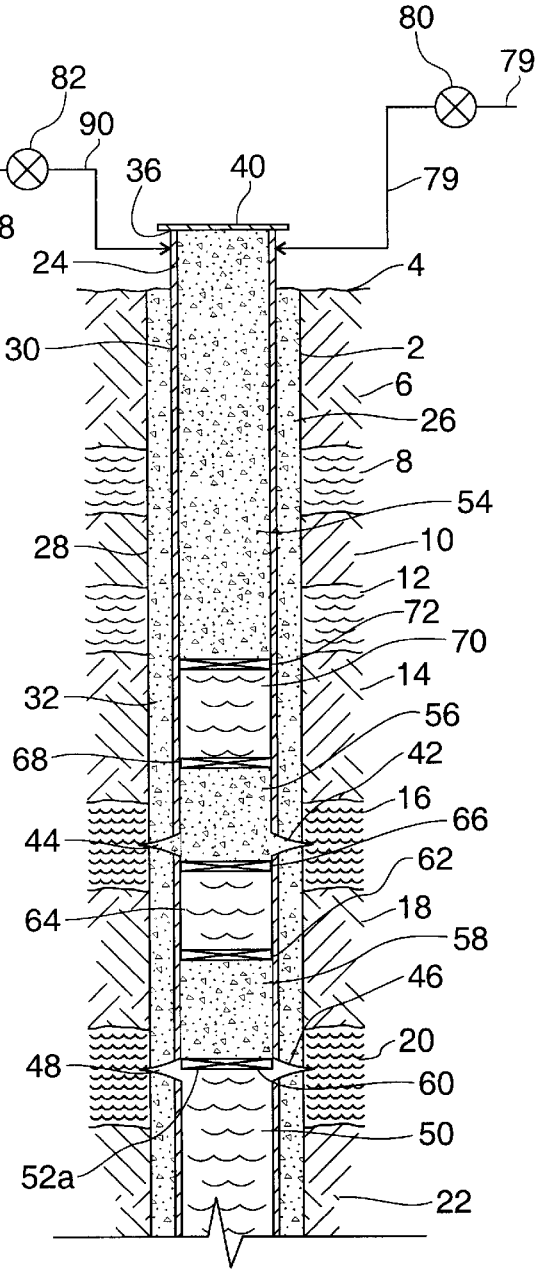
FIG. 2 is a drawing of the abandoned well shown in FIG. 1 which has been plugged in accordance with the method of this invention.

A tubular metal casing 24 is installed in bore hole 2 to form annulus space 26 between wall 28 of bore hole 2 and exterior surface 30 of casing 24. A sheath of cement 32 occupies annulus 26 and extends from the bottom 34, not shown, of casing 24 in subsurface formation 22 to the top of bore hole 2 at surface 4 of the earth. Sheath 32 can be produced by means known in the art. As is well known in the art, sheath 32 supports casing 24 in bore hole 2, stabilizes bore hole 2 and isolates and protects subsurface formations 6, 8, 10, 12, 14, 16, 18, 20 and 22 which are penetrated by bore hole 2. The structure thus described can be referred to as a well wherein the interior of casing 24 can be adapted to admit and contain fluids originating from formations penetrated by bore hole 2 to enable such fluids to be conducted to surface 4. For purposes of definition, the portion of bore hole 2 containing fluid originating from formations penetrated by bore hole 2 is referred to as the well bore. In FIGS. 1 and 2 the well bore is the interior of casing 24 and is referred to as well bore 38.

The top 36 of casing 24 is permanently sealed by cap 40. As shown in FIG. 1, no equipment is connected to well bore 38 to enable the transport of fluids from formations penetrated by bore hole 2 to surface tanks or treating facilities. The well is thus considered to be abandoned.

The abandoned well shown in FIG. 1 penetrates several subsurface formations including formations 8 and 12, which do contain fresh, or potable, water, and formations 16 and 20, which do not contain fresh water. Well bore 38 is in direct communication with formation 22, and is also in direct communication with formations 16 and 20. In this regard holes 42 and 44, called perforations, made by well known means, exist in the wall of casing 24 and in cement sheath 32 and extend from well bore 38 into formation 16. Similarly, perforations 46 and 48 extend from well bore 38 through casing 24 and sheath 32 into formation 20. An unobstructed path of communication thus exists between formations 16 and 20 and surface 4 via perforations 42, 44, 46 and 48 and well bore 38.

A static column of well fluid 50 originating from either one or both of formations 16 and 20 occupies a portion of well bore 38. Well fluid 50 is comprised of water, which is not fresh, and can also include hydrocarbons and other components. Formation 22 is in direct contact with well fluid 50. In one aspect, the hydrostatic pressure produced by well fluid 50 at formation 22 is balanced by the pore pressure of formation 22, accordingly well fluid 50 does not enter formation 22. In another aspect, formation 22 is not sufficiently permeable and porous to permit well fluid 50 to drain therein by gravity or by applied pressure less than that required to fracture the same. In this later case, formation 22 could be cement placed in bore hole 2 during primary cementing. Well fluid 50 thus poses a contamination threat to fresh water contained in formations 8 and 12.

The surface 52 of well fluid 50 in well bore 38 is below the top of bore hole 2 at surface 4 of the earth. The natural internal pressure of formations 16 and 20, that is the pore pressure, is insufficient to cause the surface 52 of well fluid 50 to extend to surface 4, but is of sufficient intensity to maintain well fluid 50 in a static condition as shown in FIG. 1.

Referring now to FIG. 2, the abandoned well shown in FIG. 1 has been plugged by masses of hardened cementitious material 54, 56 and 58 positioned in separate portions of well bore 38 adjacent to formations 8 and 12, which do contain fresh water, and formations 16 and 20, which do not contain fresh water. Cementitious material 54, 56 and 58 are thus positioned in well bore 38 to protect formations 8 and 12 from fluids, such as salt water and hydrocarbons liquid, which migrate from formations 16 and 20, and to prevent such fluid migration from formations 16 and 20. Notice that cementitious material 54 continuously extends from a point below the bottom of formation 12 to cap 40 at top 36 of casing 24 to thereby shield formations 8 and 12 from migrating fluid. Also notice that cementitious material 56 continuously extends from a point below perforations 42 and 44 which penetrate formation 16 to a point above formation 16 to thereby prevent well fluid 50 from entering well bore 38 from formation 16. Notice further that cementitious material 58 continuously extends from a point at or slightly above perforations 46 and 48 which penetrate formation 20 to a point above formation 20. The cooperation of cementitious material 58 and formation 22 prevents well fluid 50 from entering well bore 38 from formation 20.

A plug 60 is positioned in well bore 38 at a point at or slightly above perforations 46 and 48. The bottom of plug 60 is believed to be adjacent to the lowest portion of the lower of perforations 46 and 48. The side surface of plug 60 is slidably pressed against the interior surface of casing 24 and the bottom surface of plug 60 is supported by well fluid 50 at surface 52*a*. Cementitious material 58 is supported by the top surface of plug 60. The top surface of cementitious material 58 is positioned at a point above the top of formation 20 and at a point below the bottom of formation 16.

A plug 62 is positioned in well bore 38 at a point below perforations 42 and 44. The side surface of plug 62 is slidably pressed against the interior surface of casing 24 and the bottom surface of plug 62 is supported by the top surface of cementitious material 58. Spacer fluid 64 is positioned in well bore 38 and is supported by the top surface of plug 62. The top surface of spacer fluid 64 terminates at a point below perforations 42 and 44. The combination of plug 60, cementitious material 58, plug 62 and spacer fluid 64 is defined herein as a "cementing unit."

A plug 66 is positioned in well bore 38 at a point below perforations 42 and 44. The side surface of plug 66 is slidably pressed against the interior surface of casing 24 and the bottom surface of plug 66 is supported by the top surface of spacer fluid 64. Cementitious material 56 is supported by the top surface of plug 66. The top surface of cementitious material 56 is positioned at a point above the top of formation 16 and at a point below the bottom of formation 12.

A plug 68 is positioned in well bore 38 at a point below the bottom of formation 12. The side surface of plug 68 is slidably pressed against the interior surface of casing 24 and the bottom surface of plug 68 is supported by the top of cementitious material 56. Spacer fluid 70 is positioned in well bore 38 and is supported by the top surface of plug 68. The top surface of spacer fluid 70 terminates at a point below the bottom of formation 12. The combination of plug 66, cementitious material 56, plug 68 and spacer fluid 70 is defined herein as a "cementing unit."

A plug 72 is positioned in well bore 38 at a point below the bottom of formation 12. The side surface of plug 72 is slidably pressed against the interior surface of casing 24 and the bottom surface of plug 72 is supported by the top of spacer fluid 70. Cementitious material 54 is supported by the top surface of plug 72. The bottom surface of cementitious material 54 is positioned at a point below the bottom of formation 12 and the top surface of cementitious 54 extends to cap 40 at top 36 of casing 24. It is clear that cementitious material 54 extends in a continuous mass from a point below formation 12 to a point above formation 8 and terminates 69 at cap 40. The combination of plug 72 and cementitious material 56 is defined herein as the "final unit."

It is clear that the abandoned well shown in FIG. 1 is plugged with two cementing units and one final unit as shown in FIG. 2.

Operation of the Invention

The porosity, permeability and formation pressure of formations 16 and 20 are first determined by an injectivity test as previously described to verify that the abandoned well is eligible for plugging by the method of this invention.

A quantity of cementitious material is then introduced into measuring tank 74 through conduit 76 which includes valve 78. The quantity of cementitious material thus introduced is equal in volume to the volume of cementitious material 58 required to occupy well bore 38 from a point at perforations 46 and 48 to a point above formation 20.

Plug 60 is then introduced into well bore 38 via line 79 which includes valve 80. The combination of line 79 and valve 80 is referred to in the well cementing art as a "plug launcher." The outer surface of plug 60 is adapted to contact and slide along the inner surface of casing 24. In addition, plug 60, including the outer surface thereof, is still further adapted to prevent the passage of fluid through or around the plug. Plug 60 thus operates to segregate well fluid 52 in contact with the bottom surface thereof from contacting and otherwise mixing with cementitious 58 in contact with the top surface thereof.

Thereafter, valves 78 and 80 are closed, valve 82 between tank 74 and top 36 of casing 24 is opened and pump 84 is activated to thereby transfer the cementitious material previously measured into tank 74 into well bore 38 via conduits 86, 88 and 90. The cementitious material is placed on and supported by the upper surface of plug 60. The combination of the hydrostatic pressure developed by cementitious material 58 and the pressure generated by pump 84 causes plug 60 to slide within casing 24 and to force at least a portion of well fluid 52 into either one or both of formations 16 and 20 via perforations 42 and 44 and perforations 46 and 48, respectively. The density of cementitious material 58 is preferably equal to or greater than the density of well fluid 52 in order to minimize the pressure required by pump 84 to force well fluid 52 to enter formations 16 and 20.

A quantity of spacer fluid is then introduced into measuring tank 74 through conduit 92 which includes valve 94. The quantity of spacer fluid thus introduced is equal in volume to the volume of spacer fluid 64 required to occupy well bore 38 from a point adjacent the top surface of cementitious material 58 to a point below perforations 42 and 44.

Plug 62 is then introduced into well bore 38 via line 79. Plug 62 and plug 60 are identical in all respects. Plug 62 operates to segregate cementitious fluid 58 in contact with the bottom top surface thereof from contacting and otherwise mixing with spacer fluid 64 in contact with the top surface thereof.

Thereafter, valves 94 and 80 are closed, valve 82 between tank 74 and top 36 of casing 24 is opened and pump 84 is activated to thereby transfer the spacer fluid previously measured into tank 74 into well bore 38 via conduits 86, 88 and 90. The spacer fluid is placed on and supported by the top surface of plug 62. The combination of the hydrostatic pressure developed by spacer fluid 64, cementitious material 58 and the pressure generated by pump 84 causes plugs 62 and 60 to slide within casing 24 and to force a still further portion of well fluid 52 into either one or both of formations 16 and 20 via perforations 42 and 44 and perforations 46 and 48, respectively. The bulk density of cementitious material 58 and spacer fluid 64 is preferably equal to or greater than the density of well fluid 52 in order to minimize the pressure required by pump 84 to force well fluid 52 to enter formations 16 and 20.

A single cementing unit consists of the combination of plugs 60 and 62, cementitious material 58 and spacer fluid 64. Upon the introduction of this cementing unit a portion of well fluid 52 has been forced into formations 16 and 20. At this time it believed that the bottom of plug 60 is approaching perforations 46 and 48.

A second cementing unit, consisting of the combination of plugs 66 and 68, cementitious material 56 and spacer fluid 70 is then introduced into well bore 38 in the manner described for introduction of the first cementing unit. Upon the completion of the introduction of the second cementing unit, it is believed that a still further portion of well fluid 52 is forced into formations 16 and 20, that the bottom of plug 60 is positioned slightly above, if not adjacent to the lowest portions of perforations 46 and 48, and the top surface of spacer fluid 70 is positioned above the bottom of formation 12.

A quantity of cementitious material is then introduced into measuring tank 74 through conduit 76. The quantity of cementitious material thus introduced is equal in volume to the volume of cementitious material 54 required to occupy well bore 38 from a point at or slightly below formation 12 to cap 40.

Plug 72 is then introduced into well bore 38 via line 79. Plug 72 and plug 60 are identical in all respects. Plug 72 operates to segregate cementitious fluid 54 in contact with the top surface thereof from contacting and otherwise mixing with spacer fluid 70 in contact with the bottom surface thereof.

Thereafter, valves 78 and 80 are closed, valve 82 between tank 74 and top 36 of casing 24 is opened and pump 84 is activated to thereby transfer the cementitious material previously measured into tank 74 into well bore 38 via conduits 86, 88 and 90. The cementitious material is placed on and supported by the top surface of plug 72. The combination of the hydrostatic pressure developed by cementitious materials 54, 56 and 58, spacer fluids 64 and 70 and the pressure generated by pump 84 cause plugs 60, 62, 66, 68 and 72 to slide within casing 24 and to force well fluid 52 into either one or both of formations 16 and 20 via perforations 42 and 44 and perforations 46 and 48, respectively. The bulk density of cementitious materials 54, 56 and 58 and spacer fluids 64 and 70 is preferably greater than the density of well fluid 52 in order to minimize the pressure required by pump 84 to force well fluid 52 to enter formations 16 and 20.

The final unit consists of the combination of plug 72 and cementitious material 54.

Upon the completion of the introduction of the final unit, it is believed that all of well fluid 52 which can be forced into formations 16 and 20 has been forced into formations 16 and 20. It is also believed that the bottom of plug 60 is positioned at or slightly below the lowest portions of perforations 46 and 48. It is further believed that the top surface of spacer fluid 70 is positioned below the bottom of formation 12. It is still further believed that top surface of cementitious material 54 is in contact with the bottom surface of cap 40.

To complete the method, cementitious materials 58, 56 and 54 are permitted to set to thereby form the hardened cementitious material as shown in FIG. 2.

The above description features the use of a single measuring tank 74. Accordingly, the method as described is conducted as a batch process because the tank is employed to contain cementitious material and spacer fluid in alternation. However, the process can be performed in at least a partial continuous flow process by the use of an additional measuring tank and appropriate connecting plumbing. In the continuous process one tank is dedicated to cementitious material and the second is dedicated to spacer fluid.

The first liquid can be, and is preferably, delivered to the sight of the well to be plugged in a standard concrete ready-mix truck. This mode of delivery permits the slurry to be prepared at a remote location to thereby avoid the necessity of equipment at the site of the well to store the ingredients and mix the slurry.

The cementitious material useful herein can be any material having hydraulic activity which is defined as a material which hardens in the presence of water. Examples of such materials include Portland cement, fly ash, lime, gypsum, granulated blast furnace slag and mixtures thereof. A preferred cementitious material is ASTM Type 1(API Class A) which is readily available in construction concrete yards.

In addition, the cementitious material can have, and preferably does have, mixed therewith a quantity of filler, such as graded sand, pozzolan, mortar sand, of the type normally employed in general concrete construction operations, and mixtures thereof. The ratio of cementitious material to filler useful herein is an amount in the range of from about 0.25 to 5, preferably 0.5 to 4 and still more preferably from about 1 to about 2 pounds of filler per pound of cementitious material. The particle size of the filler is in the range of from about 20 to 2000, preferably 50 to 500 and still more preferably from about 100 to about 200 microns. Stated differently, the particle size of the filler is usually in the range of 10 to 325 mesh U.S. Sieve Series or 44 to 2000 microns.

It is evident from above that the filler can be present in the first liquid in quantities of up to about 500% of the cementitious material and is thus an important feature of the cement hydration reaction. The filler not only functions as a diluent, but also bonds with the cement to create a solid matrix. The filler in the concentrations involved acts to reduce shrinkage and enhance the strength of the set mass. In addition, the particle size of the filler can enable the filler to act as a bridging agent to prevent or reduce slurry loss if fracture does occur. Still further, the filler aids the effectiveness of low shear mixing ordinarily employed in ready mix applications which permits the preparation and pumping of low viscosity cement which is associated with high set strength cement and reduced water shrinkage.

The cementitious material or the combination of cementitious material and filler is mixed with water to produce the first liquid, a slurry, which can be transferred by pump 84 as shown in FIG. 2. The ratio of cementitious material to water useful herein is an amount in the range of from about 0.36 to 0.56, preferably 0.40 to 0.53 and still more preferably from about 0.44 to about 0.50 pounds of water per pound of cementitious material.

Cement set time retarders can also be employed in the first liquid to control the setting of cement employed in the cementing units and final unit to avoid premature hardening while the method is being performed. Set time retarders and the methods of their use are well known in the art of well cementing.

The first liquid prepared according to the above recipe has a density in the range of from about 100 to about 150 pounds of slurry per cubic foot of slurry.

The pump, such as pump 84 shown in FIG. 2, used to transfer the first liquid (and the second liquid) from measuring tank 74 to well bore 38 is any positive displacement, transfer pump capable of pumping a viscous fluid suspending large-diameter solids. Such pumps useful herein are known as concrete pumps and are capable of being towed on a trailer by a pickup truck.

The second liquid functions to space adjacent quantities of slurry and is thus also referred to as a spacer fluid. Spacer fluids remain in the liquid phase and do not harden. The density of spacer fluids employed herein can be less than, equal to or greater than the density of the first liquid. It is merely preferred that the bulk density of the total quantity of first liquid and the total quantity of second liquid employed to form a plug in a particular well bore be greater than the density of the well fluid in that particular well.

Spacer fluids known in the art are useful herein. Such fluids, which are preferably inert to the environment in which they are placed, include drilling fluid, water, produced formation water and gelled water containing additives. Examples of such additives are corrosion inhibitors, weighting agents and dispersants. The density of known spacer fluids useful herein can be in the range of from about 63 to about 150 pounds per cubic foot of fluid.

The dense spacing discs or plugs are placed between successive quantities of second liquid and first liquid or between well fluid and first liquid as the case may be. The discs, which are ordinarily insoluble solid plugs, are well known in the art of well cementing as wiper plugs and are readily available from a variety of well service company suppliers. The wiper plugs operate to support liquid placed on their top surfaces, to prevent intermixing of the liquids between which the plugs are placed and are designed to fit tightly against the interior wall of a casing and yet readily slide against such wall upon the application of hydrostatic pressure. Examples of such plugs include Haliburton five wiper plugs and Industrial Rubber

EXAMPLE

A cementitious plug was placed in the well bore of an abandoned well in accordance with the method of this invention. The well contained a 4.5 inch casing and was 2179 feet deep. The annular space was cemented from the bottom to the surface and the casing was perforated at 1681 feet and 1689 feet below the surface. An injectivity test was performed in which 70 barrels of salt water were pumped into the casing. The casing could not be filled with water. The well was on a vacuum. It was reported that the water entered the perforations at about 3 barrels per minute at 0 psi.

A cement slurry was prepared and transported to the well location in a ready mix truck. The slurry contained Class A cement, 200% sand by weight of cement, 0.6% lignosulfonate set time retarder by weight of cement and sufficient water to produce a slurry having a density of 18 pounds of slurry per gallon of slurry (134.63 pounds per cubic foot).

A rubber plug was placed in the casing. Then, 6.5 barrels of the cement slurry were pumped into the casing on top of the plug. A second rubber plug was placed in the casing on top of the slurry and then 15.6 barrels of salt water spacer fluid were placed on top of the second plug.

Thereafter, a third rubber plug was placed in the casing on top of the spacer fluid which was followed by a quantity of slurry required to fill the remainder of the casing, about 350 feet. The well bore was filled to the surface. Operations were terminated.

The well was checked the next day. It was observed that the cement had set to a hard mass and that the surface of the mass was about 3 feet below the surface of the earth.

Having described the invention that which is claimed is:

1. A method of forming a mass of hardened cementitious material in a well bore penetrating the earth, said method being comprised of the steps of:

selecting a well bore extending from the surface of said earth to at least one subterranean formation containing a well fluid, said well bore having communication means with said subterranean formation and having a static column of said well fluid standing therein, wherein the top of said column of said well fluid is positioned below said surface of said earth;

introducing into said well bore at least a first cementing unit and permitting said first cementing unit to contact said top of said column of said well fluid, wherein said cementing unit is comprised of a first solid plug, a quantity of a first liquid comprised of said cementitious material dispersed in water, a second solid plug and a quantity of a second liquid, wherein said cementitious material has hydraulic activity;

permitting said cementing unit to force said well fluid into said subterranean formation through said communication means while, simultaneously, placing said cementing unit in said well bore so that the bottom of said first liquid is positioned adjacent said subterranean formation and the top of said first liquid is positioned above the top of said subterranean formation;

introducing into said well bore a final cementing unit which is comprised of a final solid plug and a final quantity of said first liquid whereby the top of said final quantity of said first liquid is positioned substantially at said surface of said earth; and permitting said first liquid to set to thereby form said mass of hardened cementitious material in said well bore;

wherein said first solid plug, said second solid plug and said final solid plug are each in contact with and slide along the interior wall of said well bore and substantially prevent movement of liquid between each said solid plug and said interior wall of said well bore.

2. The method of claim 1 wherein said well bore has a tubular casing installed therein, said casing having an exterior and an interior and being perforated at a point adjacent said subterranean formation to thereby provide said communication means between said interior of said casing and said subterranean formation.

3. The method of claim 2 wherein said cementitious material is selected from the group consisting of Portland cement, fly ash, lime, gypsum, granulated blast furnace slag and mixtures thereof.

4. The method of claim 3 wherein said first liquid is further comprised of a filler, wherein said filler, said cementitious material and said water are mixed together to produce a slurry which will flow down said well bore.

5. The method of claim 4 wherein said filler is selected from mortar sand, graded sand, pozzolan and mixtures thereof.

6. The method of claim 4 wherein said second liquid is a spacer fluid.

7. The method of claim 6 wherein the density of said spacer fluid can be less than, equal to or greater than the density of said first liquid.

8. The method of claim 7 wherein said spacer fluid is comprised of fresh water, produced formation water and salt water.

9. The method of claim 4 wherein said first liquid is mixed in a ready-mix truck and transported therein to the location of said well bore.

10. The method of claim 2 wherein said well bore penetrates at least two subterranean formations, wherein at least a first of said subterranean formations contains fresh water and is positioned above a second of said subterranean which contains said well fluid which is not fresh water.

11. The method of claim 10 comprising introducing a second cementing unit into said well bore prior to said introduction of said final cementing unit into said well bore and contacting said first cementing unit with said second cementing unit, wherein said second cementing unit is substantially identical in content and sequence to said first cementing unit; and permitting said first cementing unit and said second cementing unit to force said well fluid into said subterranean formation while, simultaneously, placing said second cementing unit in said well bore so that the bottom of said first liquid contained therein is positioned below the bottom of said subterranean formation containing said fresh water and the top of said first liquid contained in said second cementing unit is positioned above the top of said subterranean formation containing said fresh water.

12. A method of forming a mass of hardened material in a well bore penetrating the earth said method being comprised of the steps of:

selecting a well bore extending from the surface of said earth to and having unimpeded contact with at least one subterranean formation containing a well fluid, said well bore having a static column of said well fluid standing therein, wherein the top of said column of said well fluid is positioned below said surface of said earth;

contacting said top of said column of said well fluid with at least one cementing unit by introducing into said well bore said cementing unit which is comprised of a first solid plug and a quantity of a first liquid comprised of a material having hydraulic activity and water;

permitting said cementing unit to force said well fluid into said subterranean formation while, simultaneously, placing said cementing unit in said well bore whereby the bottom of said first liquid is adjacent to said subterranean formation and the top of said first liquid is positioned substantially at said surface of said earth; and permitting said first liquid to set to thereby form said mass of hardened material in said well bore;

wherein said first solid plug is in contact with and slides along the interior wall of said well bore and substantially prevents movement of liquid between said solid plug and said interior wall of said well bore.

* * * * *